US005224912A

United States Patent [19]

Moody

[11] Patent Number: 5,224,912

[45] Date of Patent: Jul. 6, 1993

[54] PUNCHING BAG SUPPORT APPARATUS

[76] Inventor: Matthew T. Moody, 230 Lindsey Lake Rd., Travelers Rest, S.C. 29690

[21] Appl. No.: 784,462

[22] Filed: Oct. 24, 1991

[51] Int. Cl.[5] ..... A63B 69/24

[52] U.S. Cl. ..... 482/87; 482/86

[58] Field of Search ..... 482/86, 87; 273/55 A

[56] References Cited

U.S. PATENT DOCUMENTS

| | | | |
|---|---|---|---|
| 2,156,831 | 5/1939 | Andre | 482/86 |
| 3,547,438 | 12/1970 | Schmitter | 273/55 A |
| 4,911,428 | 3/1990 | Wiece | 482/87 |
| 5,048,822 | 9/1991 | Murphy | 482/87 |

*Primary Examiner*—Richard J. Apley
*Assistant Examiner*—Lynne A. Reichard
*Attorney, Agent, or Firm*—John B. Hardaway, III; Jeffrey L. Wilson; J. Bennett Mullinax

[57] ABSTRACT

A punching bag support apparatus is provided comprising a mounting plate, a pivot shaft, an elongated rail rotably attached to the pivot shaft, and a trolley frame slidably riding on and supported by the rail, thereby enabling a punching bag supported on the trolley frame to be moved rotationally about the central vertical axis of the support apparatus as well as able to be linearly moved through the central vertical axis of the support apparatus.

8 Claims, 2 Drawing Sheets

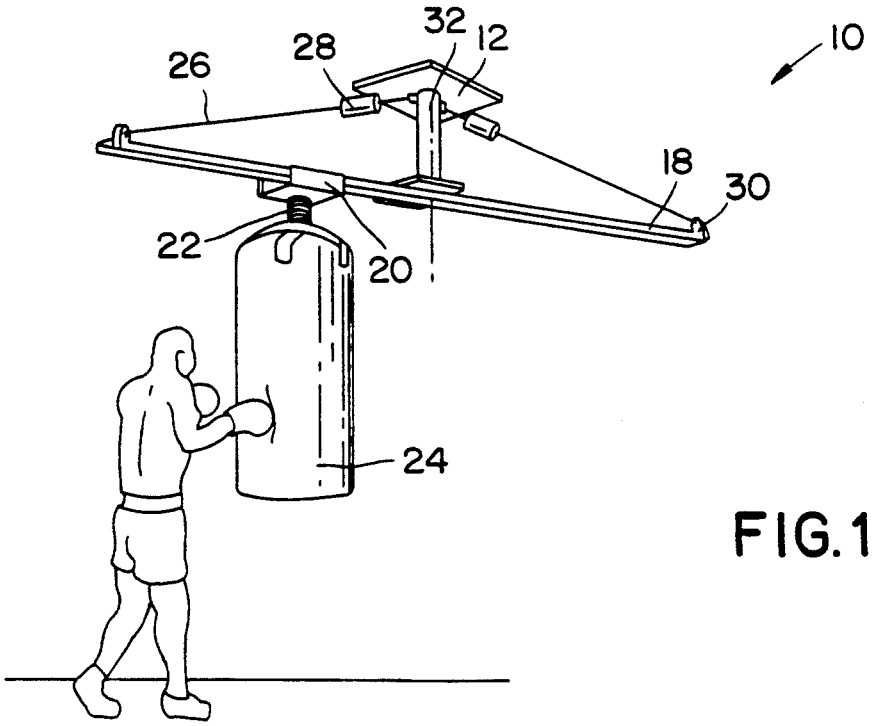
FIG. 1
FIG. 3
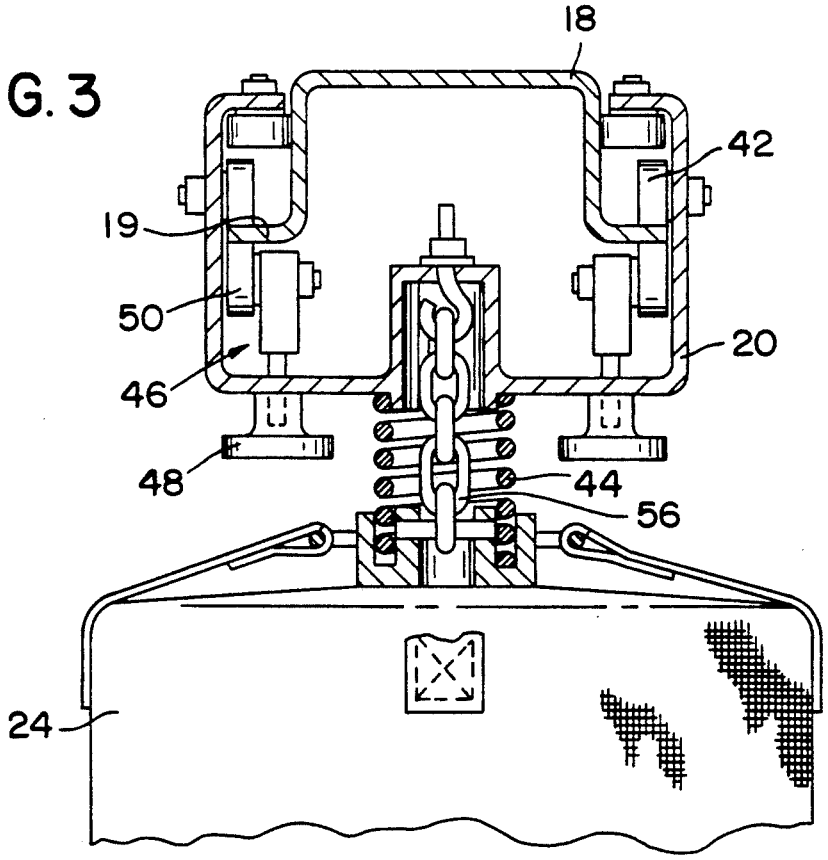

PUNCHING BAG SUPPORT APPARATUS

BACKGROUND OF INVENTION

This invention relates generally to the art of support apparatuses, and more particularly to the art of a support apparatus for a punching bag.

Various support devices exist within the prior art. It has been desirable to provide such support apparatuses which are capable of supporting a punching bag so that a person can practice on the punching bag by himself or with the aid of a trainer. It is even more desirable, however, to provide a punching bag support apparatus which is moveable in order to provide a person using the bag with a more realistic workout. U.S. Pat. No. 4,911,428 discloses a support for a punching bag comprising a horizontally disposed beam supported from an overhead support for rotation about a vertical axis with a punching bag supported at one end of the beam and an adjustable caster wheel at the other end of the beam for rolling engagement with the overhead support, thereby enabling the punching bag to move in a circle about the rotational axis of the beam, either clockwise or counterclockwise. While this prior art apparatus functions well for its intended purpose, room for improvement exists.

SUMMARY OF THE INVENTION

It is thus an object of this invention to provide a novel punching bag support apparatus.

It is a further object of this invention to provide such a novel punching bag support apparatus which enables a punching bag supported thereon to be rotationally moveable about a central vertical axis of the support apparatus.

It is still a further object of this invention to provide such a novel punching bag support apparatus which enables a punching bag supported thereon to be linearly moveable through a central vertical axis of the support apparatus.

These as well as other objects are accomplished by a punching bag support apparatus comprising a mounting plate, a pivot shaft extending from the mounting plate, an elongated rail rotably attached to an end of the pivot shaft, a trolley frame slidably riding on and supported by the elongated rail, and means for supporting a punching bag included on the trolley frame.

BRIEF DESCRIPTION OF THE DRAWINGS

FIG. 1 is a perspective view of the punching bag support apparatus.

FIG. 3 is a cross section view along line 3—3 of FIG. 2, illustrating a preferred structure of the punching bag support apparatus according to this invention.

DETAILED DESCRIPTION

Figure 2:
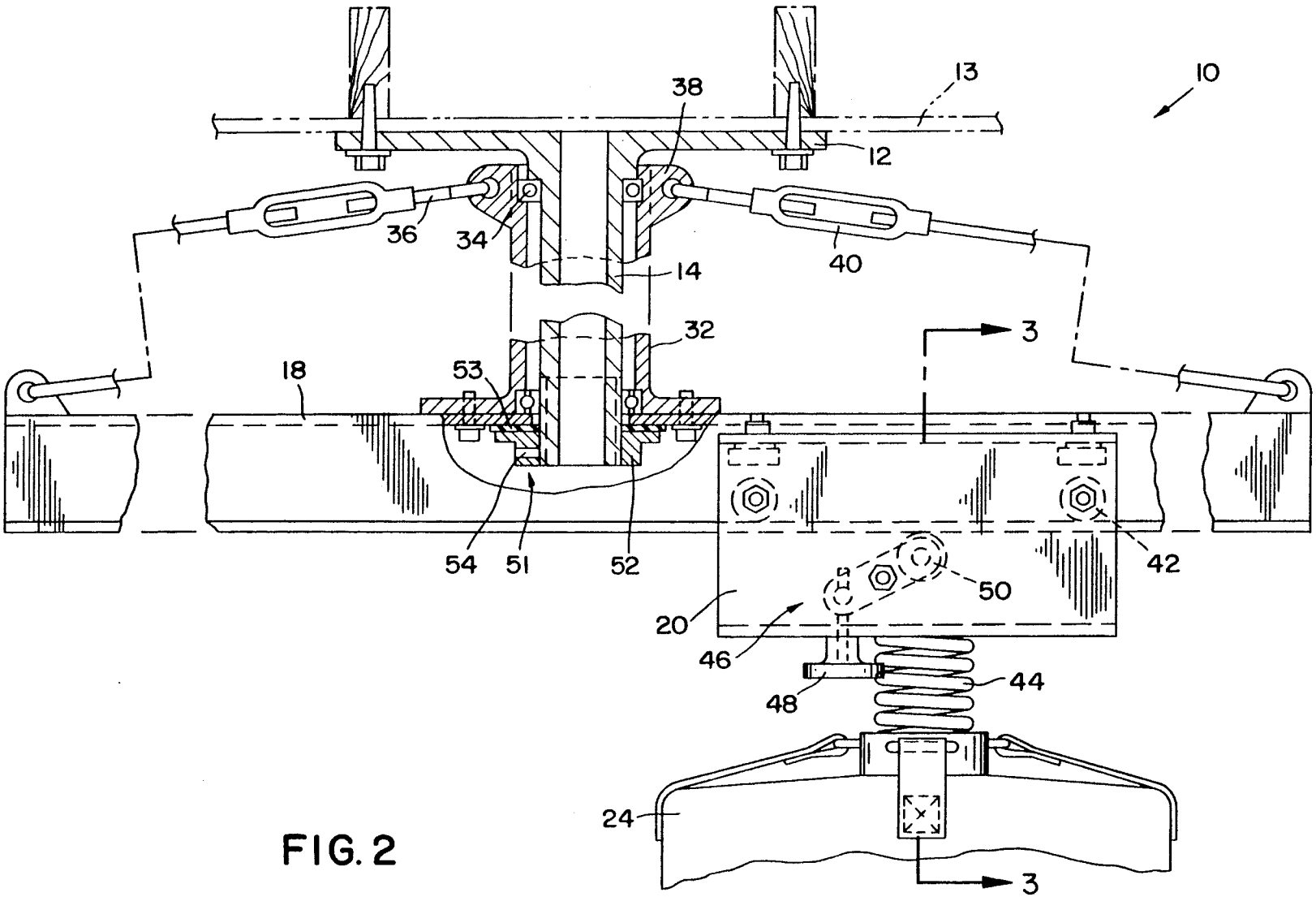
FIG. 2 is a fragmentary perspective view of the punching bag support apparatus.

In accordance with this invention, it has been found that a novel punching bag support apparatus can be provided. It has also been found that such a novel punching bag support apparatus can be provided which enables a punching bag supported thereon to be rotationally moveable about a central vertical axis of the support apparatus. It has further been found that such a novel punching bag support apparatus can be provided which enables a punching bag supported thereon to be linearly moveable through a central vertical axis of the support apparatus.

Various other advantages and features will become apparent from a reading of the following description given with reference to the various figures of drawings.

FIG. 1 of the drawings is a perspective view of the punching bag support apparatus 10. As illustrated, punching bag support apparatus 10 comprises a mounting plate 12 which has a pivot shaft 14 extending therefrom. A collar 32, used in the preferred embodiment, surrounds the pivot shaft 14 (seen in FIG. 2) which extends from the mounting plate 12. Collar 32 secures elongated rail 18 to the pivot shaft 14 such that elongated rail 18 is rotationally moveable about pivot shaft 14, which is the central vertical axis of punching bag support apparatus 10.

Elongated rail 18 is in a horizontal position generally parallel to mounting plate 12. A trolley frame 20 slidably rides on and is supported by elongated rail 18. Trolley frame 20 also includes means for supporting 22 a punching bag 24. Also seen in FIG. 1 are tension rods 26 which include turnbuckles 28. Tension rods 26 extend from the top of collar 32 near mounting plate 12 to anchors 30 formed on the ends of elongated rail 18 in order to provide stability to elongated rail 18 when punching bag 24 is moved across elongated rail 18. Trolley frame 20 therefore allows punching bag 24 to be linearly moveable along elongated rail 18 through the central vertical axis of punching bag support apparatus 10.

FIG. 2 is a fragmentary perspective view of the punching bag support apparatus 10. Mounting plate 12 is shown as being attached to a ceiling 13. Pivot shaft 14 extends generally from the center of mounting plate 12, and elongated rail 18 is rotably attached to pivot shaft 14 by a collar 32 in the preferred embodiment. In this preferred embodiment, bearings 34 are positioned between collar 32 and pivot shaft 14 in order that collar 32 can rotate around pivot shaft 14. Collar 32 surrounds pivot shaft 14 and attaches to elongated rail 18 to secure elongated rail 18 to pivot shaft 14. By this attachment of elongated rail 18 to pivot shaft 14, elongated rail 18 is rotationally moveable, either clockwise or counterclockwise, about pivot shaft 14 which is the central vertical axis of punching bag support apparatus 10.

FIG. 2 also illustrates tension rods 36 which extend from anchors 30 on the ends of elongated rail 18 to near the top of collar 32. Tension rods 36 provide stability to elongated rail 18 when a punching bag 24 is moved along elongated rail 18. Turnbuckles 40 are used with tension rods 36 in the preferred embodiment for adjustment of tension rods 36.

Trolley frame 20 rides on and is supported by elongated rail 18 so that trolley frame 20 can slide linearly along elongated rail 18. Rollers 42 are illustrated in phantom to enable trolley frame 20 to slidably ride upon elongated rail 18. Trolley frame 20 also includes means for supporting a punching bag which may include a compression spring such as spring 44 to provide greater stability to punching bag 24. An adjustable braking means 46 for controlling trolley frame 20 is also seen in partial phantom in FIG. 2. Adjustable braking means 46 comprises a knob 48 which can be adjusted to force roller 50 against elongated rail 18. In this manner, the linear movement of trolley frame 20 along elongated rail 18 can be controlled and adjusted as desired.

Also illustrated in FIG. 2 is an adjustable rotational breaking means 51 to control the rotation of elongated rail 18 around pivot shaft 14. Adjustable rotational braking means 51 comprises a pad 53 which is pressed upward against elongated rail 18 and surrounds pivot shaft 14. Ring 52 matingly engages the bottom of pivot shaft 14 and can be adjusted to apply more or less pressure to force pad 53 against elongated rail 18. Screw 54 can be used for greater precision in adjusting rotational braking means 51. In the preferred embodiment adjustable rotational braking means 51, through adjustment of ring 52 and screw 54, is used to control the rotation of elongated rail 18 and collar 32 about pivot shaft 14.

FIG. 3 is a cross section view along line 3—3 of FIG. 2 illustrating the preferred structure of punching bag support apparatus 10. In the preferred embodiment, elongated rail 18 has an inverted generally U-shaped cross section with outwardly directed flanges 19 formed on the edges thereof. Trolley frame 20 is illustrated as including two pairs of rollers 42 which ride against the top side of elongated rail 18 and enable trolley frame 20 to slidably ride along flanges 19 and against elongated rail 19 while being supported by elongated rail 18. FIG. 3 also illustrates adjustable braking means 46 which can be used to control the movement of trolley frame 20 along elongated rail 18. Adjustable braking means 46 comprises a knob 48 which can be adjusted to force roller 50 against flange 19 of elongated rail 18. Trolley frame 20 also includes means for supporting punching bag 24, such means including chain 56 and spring 44.

As illustrated in FIG. 3, trolley frame 20 supporting punching bag 24 therefore slidably rides along elongated rail 18 and can be linearly moved along the length of elongated rail 18 as desired. During a boxing workout, a trainer can push punching bag 24 along the length of elongated rail 18 towards a boxer. As illustrated in FIGS. 1 and 2 of the drawings, it is also seen that punching bag 24 can be moved clockwise or counterclockwise about pivot shaft 14. The combination of these two movements, the clockwise or counterclockwise movement and the linear movement along elongated rail 18, enables a trainer to more realistically work with a boxer and even allows a boxer wishing to work out by himself to have a more realistic and responsive workout with punching bag 24.

It is thus seen that the present invention provides a novel punching bag support apparatus. It is also seen that the present invention provides such a novel punching bag support apparatus which enables a punching bag supported thereon to be rotationally moveable about a central vertical axis of the support apparatus. It is still further seen that such a novel punching bag support apparatus is provided which enables a punching bag supported thereon to be linearly moveable through a central vertical axis of the support apparatus. Many variations are apparent to those of skill in the art, and such variations are embodied within the spirit and scope of the present invention as measured by the following appended claims.

That which is claimed:

1. In combination with a punching bag, a bag support apparatus comprising:

a mounting plate having a central area;

a pivot shaft extending from said central area of said mounting plate;

an elongated rail rotably attached to said pivot shaft, said elongated rail being generally horizontal and parallel to said mounting plate; and a trolley frame slidably riding on and supported by said elongated rail;

said elongated rail being freely rotatable on said pivot shaft permitting said elongated rail to freely rotate while supporting said trolley frame and said punching bag;

means for supporting a punching bag included on said trolley frame.

2. The punching bag support apparatus according to claim 1 wherein said elongated rail is generally inverted U-shaped in cross section having flanges on the edges thereof and said trolley frame includes a plurality of rollers which ride on and are supported by said flanges of said elongated rail.

3. The punching bag support apparatus according to claim 2 further including adjustable braking means for controlling said trolley frame.

4. The punching bag support apparatus according to claim 1 further including adjustable rotational braking means for controlling said rotably attached elongated rail.

5. The punching bag support apparatus according to claim 1 wherein said elongated rail is rotably attached to said pivot shaft by a collar substantially surrounding said pivot shaft with bearings between said collar and said pivot shaft.

6. The punching bag support apparatus according to claim 1 wherein said means for supporting a punching bag includes a compression spring.

7. In combination with a punching bag, a punching bag support apparatus comprising:

a mounting plate having a central area;

a pivot shaft extending from said central area of said mounting plate;

an elongated rail rotably attached to said pivot shaft, said rail being generally horizontal and parallel to said mounting plate, said elongated rail having generally inverted U-shaped cross section;

a trolley frame slidably riding on and supported by said rail by a plurality of rollers;

said elongated rail being freely rotatable on said pivot shaft permitting said elongated rail to freely rotate while supporting said trolley frame and said punching bag;

means for supporting a punching bag included on said trolley frame;

adjustable braking means for controlling said trolley frame; and adjustable rotational braking means for controlling said rotably attached elongated rail.

8. In combination with a punching bag, a punching bag support apparatus comprising:

a mounting plate having a central area;

a pivot shaft extending from said central area of said mounting plate;

an elongated rail rotably attached to said pivot shaft, said elongated rail being generally horizontal and parallel to said mounting plate; and a trolley frame slidably riding on and supported by said elongated rail;

said elongated rail being freely rotatable on said pivot shaft permitting said elongated rail to freely rotate while supporting said trolley frame and said punching bag;

tension rods connected by turn buckles extending from said collar to said elongated rail; and means for supporting a punching bag included on said trolley frame.

* * * * *